US005088737A

United States Patent [19]

Frank et al.

[11] Patent Number: 5,088,737

[45] Date of Patent: Feb. 18, 1992

[54] PLAYER OPERABLE LOTTERY MACHINE WITH SYSTEM FOR AUTOMATICALLY IDENTIFYING SPHERES

[76] Inventors: Alan Frank, 886 Hillgate Pl.; Cindy B. Schiavon, 316 Camelot Dr.; Diane Frank, 886 Hillgate Pl., all of Pittsburgh, Pa. 15220

[21] Appl. No.: 581,051

[22] Filed: Sep. 12, 1990

[51] Int. Cl.[5] ..... A63F 7/00

[52] U.S. Cl. ..... 273/138 A; 273/139; 273/144 B

[58] Field of Search ..... 273/138 R, 138 A, 139, 273/144 R, 144 A, 144 B, 145 R, 144 E

[56] References Cited

U.S. PATENT DOCUMENTS

| | | | |
|---|---|---|---|
| 4,373,726 | 2/1983 | Churchill et al. | 273/138 A |
| 4,494,197 | 1/1985 | Troy et al. | 273/274 X |
| 4,601,471 | 7/1986 | Frank | 273/144 B |
| 4,669,729 | 6/1987 | Solitt et al. | 273/138 A |
| 4,689,742 | 8/1987 | Troy et al. | 273/138 A X |
| 4,786,056 | 11/1988 | Dunnignan | 273/144 A |
| 4,832,341 | 5/1989 | Muller et al. | 273/138 A X |
| 4,892,310 | 1/1990 | Patterson | 273/144 A |
| 4,909,513 | 3/1990 | Kiyono | 273/138 A X |

FOREIGN PATENT DOCUMENTS

| | | | |
|---|---|---|---|
| 3717593 | 12/1988 | Fed. Rep. of Germany | 273/144 B |
| 2083936 | 3/1982 | United Kingdom | 273/138 A |

*Primary Examiner*—Edward M. Coven
*Assistant Examiner*—Sebastiano Passaniti
*Attorney, Agent, or Firm*—Birch, Stewart, Kolasch & Birch

[57] ABSTRACT

A completely automatic, player operable, currency accepting instant lottery machine including a random number generator containing air-mixed balls which are marked on their surfaces with commonly recognized digits and also marked with a uniform pattern of bar code markings arranged in tall and narrow strips. After a mixing process, the balls which have randomly settled into the lower settlement pockets of the transparent random number generator are caused to rotate by jets of compressed air directed tangentially at their surfaces in opposite directions. Bar code scanning light pens located adjacent the settlement pockets and in close proximity to the rotating, randomly selected balls read the bar codes and transmit electronic signals to a computer in the machine which compares the randomly generated number to the player's previously selected number to determine if a successful match has occurred, in which case, a redeemable ticket is dispensed.

13 Claims, 2 Drawing Sheets

PLAYER OPERABLE LOTTERY MACHINE WITH SYSTEM FOR AUTOMATICALLY IDENTIFYING SPHERES

BACKGROUND OF THE INVENTION

This invention relates generally to gaming apparatus and more particularly to lottery machines.

Existing automatic devices for accepting wagers on the daily state lotteries presently require the players to wait until the evening drawing before learning the results of their wagers. After the evening drawing, playing activity, and the stream of lottery income during the hours immediately after the evening drawing drop off dramatically because of player's natural distaste for extended delay between wager and result. No lottery machine is presently known to exist which enables a player to place small wagers on any pre-selected number and allows the player to observe the random number generating process on the spot, immediately, and in person.

A need therefore exists for a lottery machine which, among other things, provides: an instant result; is player operable; accepts coin sized wagers; allows the player to select any number he or she prefers; instantly generates a completely random number in a visible, credible and secure manner by randomly selecting some of a plurality of air-mixed, numbered spherical balls; automatically identifies the numbers of said randomly selected balls; dispenses a redeemable ticket in the event of a successful play; and enables the device's owner to ascertain and obtain a record of the device's prior activity.

Many lottery, bingo and keno type gaming devices employ random number generators which feature the visible mixing of spherical balls. In all of them, however, identification of the randomly selected balls depends upon human observation. No reliable system has been invented for automatically identifying randomly selected balls.

It is the primary object of the present invention, therefore, to overcome the aforementioned deficiencies and provide to all economic levels of the lottery playing public, the various state lottery commissions and persons responsible for maintaining and operating the devices, a means of satisfying their respective needs.

SUMMARY

Briefly, the present invention comprises a secured enclosure having external buttons enabling a person to control operation of the device's internal components. Additionally, there is provided a mechanism for accepting and metering coins which may be deposited through slot type openings in the enclosure, an air-mixed ball type random number generator which is completely visible through a transparent front portion of the enclosure, a compressor to provide the air required to mix and rotate the balls, a system for automatically determining the number of each ball which has been randomly selected, a video monitor to display playing features of the game and to provide other information to the player, and to provide authorized persons with information concerning the device's prior activity, an electronic computer to transmit and receive electronic signals, and a mechanism for printing and dispensing tickets through a slot type opening in the enclosure.

DETAILED DESCRIPTION OF THE INVENTION

Figure 1:
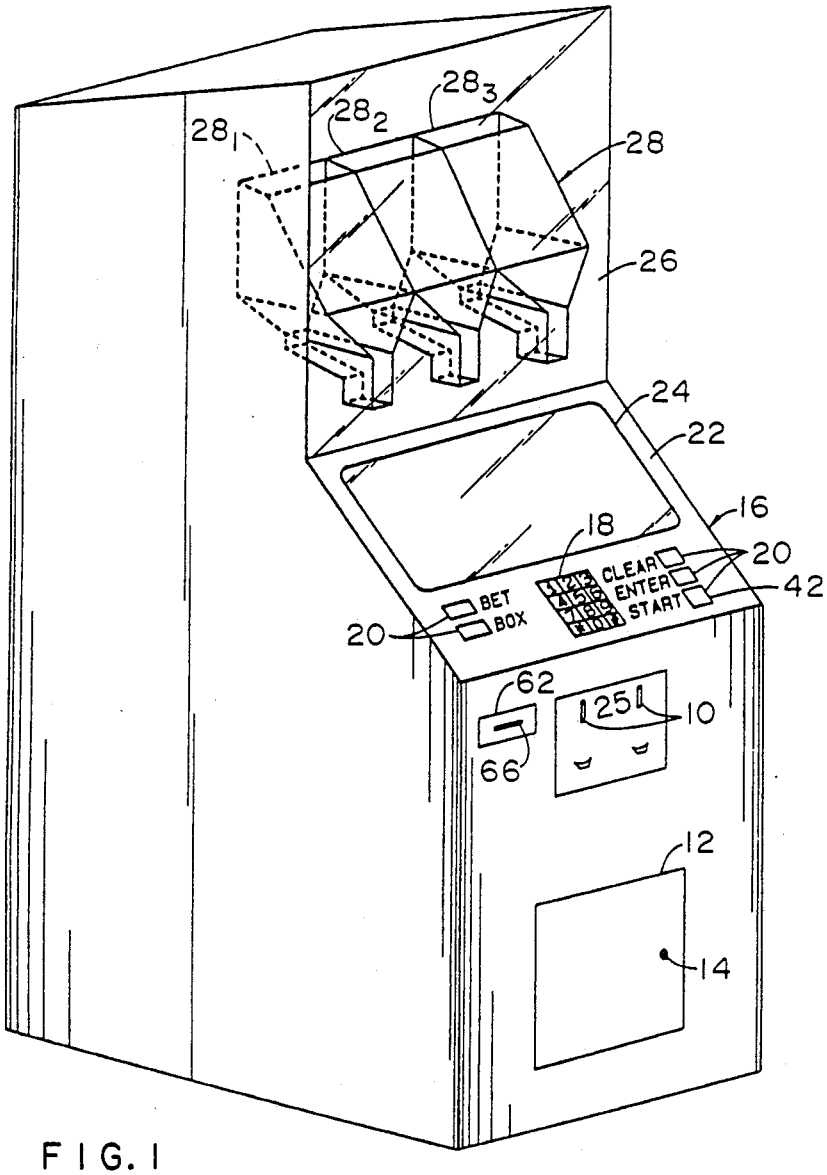
FIG. 1 is a perspective view of the preferred embodiment of the invention.

With reference to the drawings, and more particularly to FIG. 1, the enclosure shown is comprised of any suitable building material such as wood, plastic or metal. Openings 10 are provided for receiving deposited coins. A lower door type opening 12 equipped with a locking device 14 enables authorized persons to gain access to the interior for removal of deposited cash. The control panel 16 comprises a number pad 18 and manually operated buttons 20 for controlling the device's internal components. Sloping upwardly from the control panel 16 is a transparent panel 22 covering a video monitor 24.

Rising vertically from the rear of the sloping transparent panel 22, is a transparent panel 26 which covers the triple chamber random number generator 28. This configuration allows the device player to observe the video monitor 24, the random number generator 28 and the control panel 16 from a single position in close proximity to the player's eyes.

Figure 2:
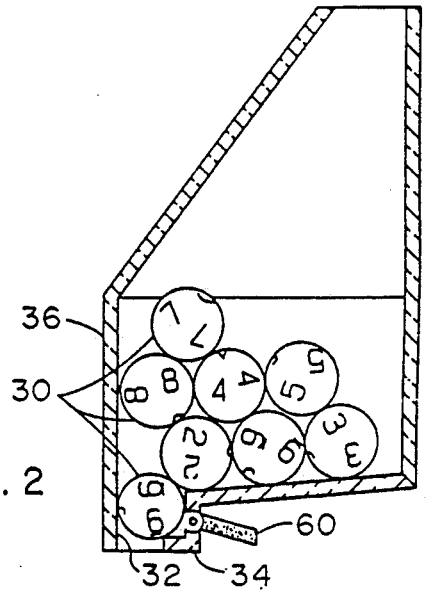
FIG. 2 is a central vertical cross sectional view of one of the mixing chambers shown in FIG. 1.

The triple random number generator 28 of the preferred embodiment is comprised of three chambers $28_1$, $28_2$, and $28_3$. They are constructed of acrylic sheets, the front of which sheets is transparent. Thirty lightweight balls 30, some of which are shown in FIG. 2, are inserted into the random number generator 28, ten in each of the three chambers. The arrows in FIG. 4 illustrate the path of compressed air during a mixing cycle.

FIG. 2 is illustrative of several of the numbered balls 30 at rest in one of the three mixing chambers. The ball marked with the number "6" is positioned in one of the settlement pockets 32. Each ball included in the chamber $28_1$, $28_2$, and $28_3$ is visibly and differently marked with a single digit ranging from zero to nine at various locations on its surface so that regardless of its orientation during the mixing process, the identification process, or while at rest, its number is constantly visible to the player. Each randomly selected ball rests upon a lower ledge 34 and is visible to the player through upright, transparent front panel 36.

Figure 3:
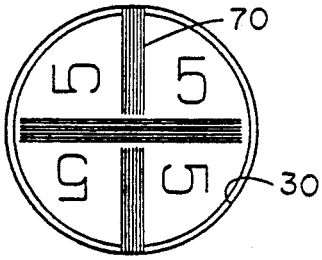
FIG. 3 is a top planar view of one of the balls in the mixing chamber having bar code indicia thereon.

FIG. 3 shows an interlaced bar code pattern applied to one of the numbered balls 30. In an alternate embodiment, the bar code pattern is applied with infrared reactive ink and covered over with infrared transparent, human opaque ink, rendering the bar code invisible to the player, but detectable by the bar code scanner.

Figure 4:
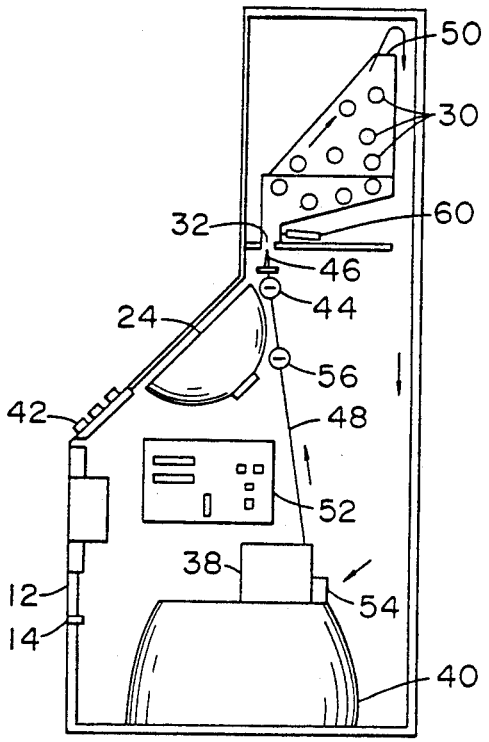
FIG. 4 is a side planar view schematically illustrative of the structure shown in FIG. 1.
Figure 5:
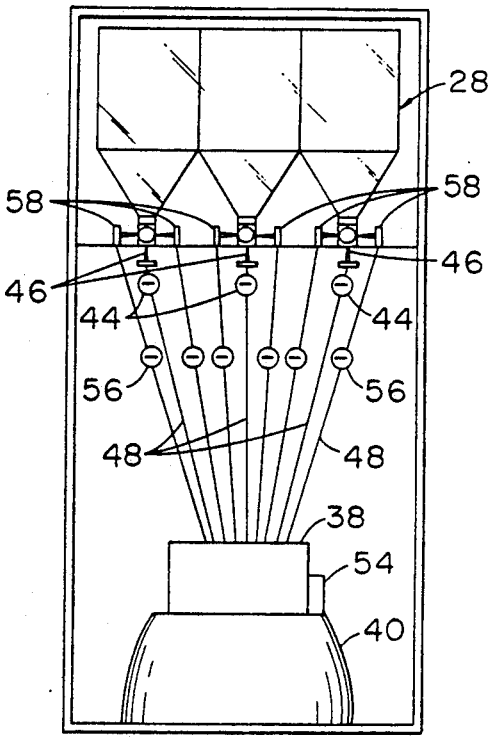
FIG. 5 is a rear planar view schematically illustrative of the structure shown in FIG. 1.
Figure 6:
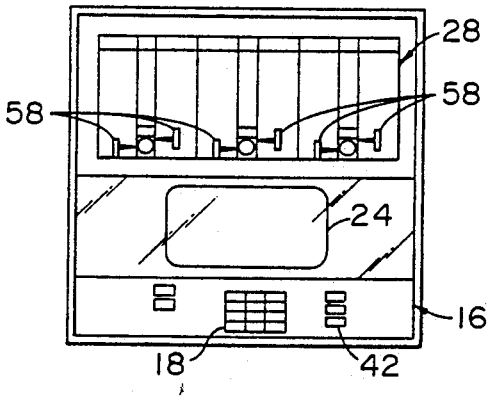
FIG. 6 is a top planar view schematically illustrative of the structure shown in FIG. 1.

FIGS. 4, 5, and 6 schematically display a motor driven compressor 38 which supplies mixing air to storage tank 40. A start button 42, located on control panel 16, causes mix valves 44 to open and allow compressed air to flow from storage tank 40 to mix nozzles 46 via tubular conduits 48. The mix nozzles 46 are directed upward and affixed below the settlement pockets 32. Compressed air exits the mix nozzles 46 and enters the mixing chambers at sufficient velocity to propel the spheres upward. The air then exits the mixing chambers through upper openings 50, and returns to the inlet 54 of the compressor 38.

The balls remain within the mixing chambers, float, bounce around, and collide with other balls which preceded them upwardly. After a random period of time, the computer 52 signals the three mix valves 44 to close, whereupon the upward air flow stops and one randomly selected ball settles into each settlement pocket 32.

Immediately thereafter, the rotation process for identifying the randomly selected balls begins. The computer 52 automatically signals six rotation valves 56 to open, thereby allowing compressed air to flow from storage tank 40 to six rotation nozzles 58, from which nozzles the air exists at high velocity. Two rotation nozzles are affixed to, and project through the sides of each settlement pocket 32. They are directed tangentially at the surfaces of the randomly selected balls in opposite directions, along their equators, 180 degrees apart.

Bar code reading light pens 60, mounted in close proximity to the randomly selected balls in settlement pockets 32, are activated by the computer 52 simultaneously with commencement of the rotation process, thereby causing the tall and narrow bar code segments 70 applied uniformly to the surfaces of said balls to be repeatedly scanned by the light pens 60. Depending upon the bar code, which corresponds to the number on each ball, a signal is transmitted from each light pen 60 to the computer 52. The transmitted signals are sensed by the computer and converted into digits which are compared to the player's previously selected numbers to determine if a successful match has occurred.

Alternatively, a plurality of balls are randomly selected from a single chamber after completion of the mixing process by allowing said plurality to move downward into a larger lower settlement pocket which is capable of containing said plurality. All of the foregoing activity is completely visible to the player at all times.

To operate the device, a player inserts coins into the coin slots 10. Information on the video monitor 24 instructs the player how to: (a) select a number by touching the number pad; (b) place the desired wager; (c) commence the mixing process by touching start button 42; and (d) if successful, receive a redeemable ticket produced by printer mechanism 62 through slot 66.

Existing optical, electronic identification systems which employ devices to measure reflected light are ill-suited for spherical surfaces. They work best on flat or nearly flat surfaces. The present invention therefore includes an automatic system which can identify balls which may be randomly oriented with respect to the light sensing component. A preferred embodiment of the identification system of the present invention comprises identical tall and narrow bar code segment 70 which are applied to the balls in an interlaced pattern conforming to the three circumferences of a sphere which are perpendicular to each other. This pattern assures ample, uniform and lightweight coverage of the spherical surfaces with bar code markings.

Because of technological difficulties in printing narrow lines over the entire circumference of spherical surfaces, the bar codes are printed on narrow strips of a flat, adhesive medium which are then applied to each,, ball 30. The combination of the aforesaid three circumference pattern of tall and narrow bar code strips, the stationary light pens and the ball rotation process described below, create a system for identifying spherical objects automatically, with 100% accuracy, consistently.

Alternately, optical electronic bar code camera type readers, including charge coupled devices, are presented with at least one readable bar code segment without the necessity of causing the ball to be excessively rotated after completion of the mixing process.

The computer 52 includes an Intel 8088 microprocessor which is programmed to signal the video monitor 24 to display operating instructions, selected numbers, generated numbers, the amount wagered, the amount won, and the amount of credit remaining, respond to the play control buttons, automatically sequence the mixing and identifying processes, translate the bar code readings into digits, compare the randomly selected digits to the player's previously selected digits, determine if a winning match has occurred, signal the ticket printer to dispense a winning ticket either automatically or at the player's choice, and store all information desired by the state lottery commissions, device owners, device operators and auditors.

Having thus shown and described what is at present considered to be the preferred embodiment of the invention, it should be noted that the same has been made by way of illustration and not limitation. Accordingly, all modifications, alterations and changes coming within the spirit and scope of the invention are herein meant to be included.

We claim:

1. A player operable instant lottery machine comprising:

an enclosure containing computer means therein, said enclosure further having external control means by which a player may designate an amount the player desires to wager, select numbers, and activate random number generating means also included within said enclosure, said random number generating means having a plurality of indicia bearing balls which are visible from outside said enclosure, said indicia comprising patterns of light reflective lines and spaces therebetween, the light reflectivity of said lines differing from the light reflectivity of said spaces, said random number generating means further including means for causing said balls to come to rest at the bottom thereof in proximity to stationary means for emitting light to and receiving light reflected from said patterns of lines and spaces, said random number generating means also including non-coaxial streams of fluid directed generally tangentially against said balls for rotating said balls while they are in proximity to said stationary means; and means for automatically identifying said patterns of lines and spaces and thereafter generating and transmitting electronic signals to said computer means, said computer means then receiving, processing, generating and storing signals indicative of said indicia.

2. The lottery machine of claim 1 and additionally including means for dispensing a redeemable ticket from said enclosure.

3. The lottery machine of claim 1 wherein said lines and spaces comprise bar code patterns.

4. The lottery machine of claim 1 wherein said stationary means further comprises charge coupled means and image processing means coupled thereto for measuring reflected light from said patterns of lines and spaces.

5. Random number generating and opto-electronic identification means comprising:

an enclosure containing a plurality of indicia bearing fluid suspendable balls which are visible from outside said enclosure, said balls being marked with light reflective patterns of lines and spaces, the light reflectivity of said lines differing from the light reflectivity of the spaces between said lines;

means for mixing said balls by upward flowing streams of fluid;

stationary means located adjacent said enclosure for emitting light to and for receiving light reflected from said patterns of lines and spaces;

means for causing a randomly selected number of said balls in said enclosure to come to rest in proximity to said stationary means, said means stationary further including means for being responsive to said patterns of lines and spaces and generating electronic signals therefrom corresponding to said indicia; and means comprising non-coaxial streams of fluid directed generally tangentially against said randomly selected balls, for rotating said randomly selected balls upon coming to rest in said enclosure, whereby said indicia can be readily identified irrespective of the manner in which said balls come to rest in said enclosure.

6. The means of claim 5 wherein said patterns of lines and spaces comprise a plurality of sets of uniformly located bar code patterns on an outer surface of each ball.

7. The means of claim 6 wherein each bar code pattern corresponds to a predetermined number.

8. The means of claim 7 wherein said means for being responsive to said patterns of lines and spaces comprises bar code reader means.

9. The means of claim 8 wherein each said number comprises a mutually different number.

10. The means of claim 8 wherein each ball additionally includes analog indicia of said number on the outer surface thereof.

11. Means for identifying a plurality of spheres in gaming apparatus comprising:

a plurality of spheres randomly located in an enclosure;

a pattern of identical bar code segments, corresponding to respective different numbers, applied uniformly to an outer surface of each sphere;

stationary bar code reader means located adjacent said enclosure for reading the bar code patterns on a selected number of said spheres and generating electrical signals corresponding to each bar code pattern read;

means for rotating said selected number of spheres in proximity to said bar code reader means, said rotating means comprising non-coaxial streams of fluid directed generally tangentially against each sphere, said bar code reader means generating electronic signals which correspond to each said bar code pattern; and means for utilizing said electrical signals in a gaming apparatus for providing an indication of the numbers on said selected number of spheres.

12. The means of claim 11, wherein said bar code reader means includes charge coupled means and image processing means for identifying the light reflectivity characteristics of said bar code segments.

13. The means of claim 12 wherein each of said plurality of spheres additionally includes analog indicia of the respective different numbers.

* * * * *